US006431086B1

(12) United States Patent
Lloyd

(10) Patent No.: US 6,431,086 B1
(45) Date of Patent: Aug. 13, 2002

(54) COLLAPSIBLE TABLE

(76) Inventor: John T. Lloyd, 80926 Turkey Run Rd., Creswell, OR (US) 97426

( * ) Notice: Subject to any disclaimer, the term of this patent is extended or adjusted under 35 U.S.C. 154(b) by 0 days.

(21) Appl. No.: 09/597,355

(22) Filed: Jun. 19, 2000

Related U.S. Application Data

(63) Continuation of application No. 09/118,564, filed on Jul. 17, 1998, now Pat. No. 6,076,472.
(60) Provisional application No. 60/062,092, filed on Oct. 14, 1997.

(51) Int. Cl.[7] ..... A47B 23/00
(52) U.S. Cl. ..... 108/36; 108/123; 108/130
(58) Field of Search ..... 108/36, 123, 130, 108/131, 132, 133, 129, 115, 153.1, 33, 35; 5/620, 616, 655

(56) References Cited

U.S. PATENT DOCUMENTS

| | | | | |
|---|---|---|---|---|
| 441,569 | A | | 11/1890 | Lad |
| 1,170,977 | A | | 2/1916 | Konig |
| 2,326,461 | A | | 8/1943 | Howe |
| 2,643,926 | A | * | 6/1953 | Pucci ..... 108/131 |
| 3,037,215 | A | | 6/1962 | Pile |
| 3,067,975 | A | | 12/1962 | Wilcox |
| 3,359,576 | A | | 12/1967 | Pile |
| 3,416,468 | A | * | 12/1968 | Peterson et al. ..... 108/131 |
| 3,878,797 | A | | 4/1975 | Patterson |
| 4,333,638 | A | | 6/1982 | Gillotti |
| 4,354,437 | A | | 10/1982 | Logan |
| 4,575,975 | A | | 3/1986 | Eisenberg |
| 4,658,735 | A | | 4/1987 | Holton |
| 4,833,998 | A | * | 5/1989 | Everett et al. ..... 108/132 |
| 4,838,179 | A | | 6/1989 | Bing |
| 4,927,128 | A | | 5/1990 | O'Brian |
| 4,943,041 | A | | 7/1990 | Romein |
| 5,009,170 | A | | 4/1991 | Spehar |
| 5,177,823 | A | | 1/1993 | Riach |
| 5,335,676 | A | | 8/1994 | O'Brien |
| 5,524,555 | A | | 6/1996 | Fanuzzi |
| 5,606,755 | A | | 3/1997 | Romein |
| D384,850 | S | | 10/1997 | Fanuzzi |
| 5,676,062 | A | | 10/1997 | Lloyd |
| 5,699,565 | A | | 12/1997 | Petterberg |
| 5,713,834 | A | | 2/1998 | Palmer |
| 5,762,402 | A | | 6/1998 | Gillotti |
| 5,769,005 | A | | 6/1998 | Haynes |
| 5,776,085 | A | | 7/1998 | Stone et al. |
| D403,772 | S | | 1/1999 | Fanuzzi |
| 5,913,271 | A | | 6/1999 | Lloyd |
| 5,943,965 | A | | 8/1999 | Riach et al. |
| 5,974,979 | A | | 11/1999 | Grady et al. |
| 6,000,345 | A | | 12/1999 | Gillotti |

* cited by examiner

*Primary Examiner*—Peter M. Cuomo
*Assistant Examiner*—Jerry A Anderson
(74) *Attorney, Agent, or Firm*—Kolisch Hartwell Dickinson McCormack & Heuser

(57) ABSTRACT

A collapsible massage table includes two folding table pieces hingably connected to each other so that when the table is set up it has four comer regions. Each corner region is supported by a leg that is connected to the table via a folding link. Each link has a cable portion that stabilizes the link in an orientation directed toward the ground when the table is set up.

4 Claims, 8 Drawing Sheets

COLLAPSIBLE TABLE

CROSS-REFERENCE TO RELATED APPLICATIONS

This application is a continuation of U.S. patent application Ser. No. 09/118,564, filed Jul. 17, 1998, issuing as U.S. Pat. No. 6,076,472 on Jun. 20, 2000, which claims priority from U.S. Provisional Patent Application Serial No. 60/062,092, filed Oct. 14, 1997, both of which are hereby incorporated by reference. U.S. Pat. No. 5,676,062, issued Oct. 14, 1997, and U.S. patent application Ser. No. 08/950,008, filed Oct. 14, 1997, are also hereby incorporated by reference.

FIELD OF THE INVENTION

The invention relates to tables that are collapsible, lightweight and portable.

BACKGROUND OF THE INVENTION

There is a significant demand for massage tables that are collapsible. Collapsible massage tables can be compactly stored, and can be easily transported for use at different locations. As people try to improve collapsible massage table designs, two competing goals are prevalent. On one hand, it is beneficial to produce a table that weighs less so that it is easier to transport. On the other hand, lighter weight construction may compromise other important requirements for a massage table, such a strength, weight capacity and stability.

Many collapsible massage tables in use today, employ legs that are perpendicular to the table top. These designs usually require a diagonal brace connecting each leg to the center of the table. The diagonal braces stabilize the table, but add to the overall weight, complexity and cost of the design.

An alternative category of collapsible tables utilize over-the center legs. On these tables, each leg forms an acute angle with the respective end of the table when the table is set up. These designs are simpler and lighter than some others because they do not require diagonal braces linking the leg to the center of the table. However, tables with over-the-center legs have tended to lack strength or stability.

Another problem with tables that employ over-the-center legs is hat the leg length is limited compared to other designs. When a collapsible massage table is folded up, each leg must fold completely under one of the table halves. Since hyper-rotated legs are pivotally connected to the underside of the table inward from the end, the length of the leg must be shorter compared to other tables that have legs connected closer to the end.

SUMMARY OF THE INVENTION

The invention provides an improved collapsible massage table design employing over-the-center legs in combination with advantageous stabilizing mechanisms. A collapsible massage table includes two folding table pieces hingably connected to each other so tat when the table is set up it has four corner regions and a center region. Each corner region is supported by a leg that is connected to the table via a folding link. Each link has a cable portion that stabilizes the link in an orientation directed generally toward the ground when the table is set up. In preferred embodiments of the invention, the leg link is connected to the table inward from the nearest end. When the table is set up, each link is substantially co-linear with its respective leg. When the table is folded up, each link folds toward the closest end of the table. A central truss is provided under the center region of the table. A tensioned cable network connects the ends of the table with the leg links and the central truss. In another embodiment of the invention, each corner region is supported by a leg having an external brace connecting the leg to the closest end of the table to form a triangular support structure with the table piece when the table is set up.

The invention also provides improvement for tables that utilize right-angle leg orientations.

DESCRIPTION OF THE INVENTION

Figure 1:
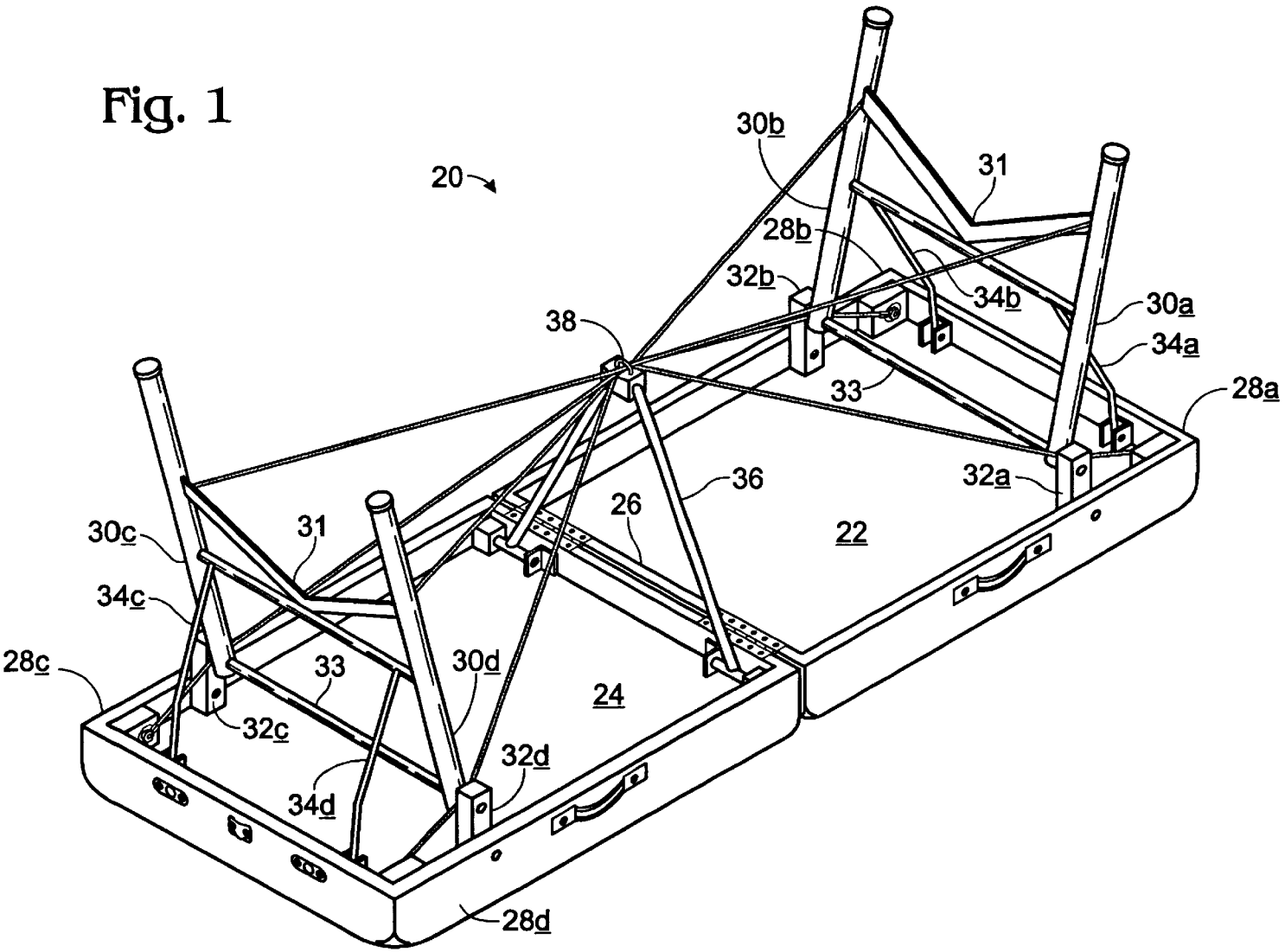
FIG. 1 is a perspective bottom view of a collapsible table according to the invention.

FIG. 1 shows a preferred embodiment of the invention from a bottom view. Table 20 includes table pieces 22 and 24 which are hinged in a center region 26 of table 20 so that table pieces 22 and 24 are substantially coplanar when table 20 is set up. When table 20 is collapsed, table pieces 22 and 24 fold together and contain all of the support cables and mechanisms shown in FIG. 1. When table 20 is set up, it has four corner regions 28*a–d*, two on each side of center region 26. Table 20 has two sides, one side spanning between corner region 28*a* and 28*d*, the other side spanning between 28*b* and 28*c*.

Unless otherwise stated, description of the support mechanism below a corner region or a side of the table, is the same for the other comer regions or side. The same numbers, with different letters, are used to designate analogous structures under different regions of the table.

Corner region 28*a* is supported by leg 30*a*. Each pair of legs at each end are braced together by a respective cross-brace structure 31. Leg 30*a* is connected to table piece 22 via pivotal link 32*a* The joints between leg 30*a* and link 32*a* on one side, and leg 30*b* and link 32*b* on the other side, are connected by cross-brace 33. Rigid external brace 34*a* connects the end of table 20 to cross-brace structure 31 near the point where the brace connects to leg 30*a*. Alternatively, external brace 34*a* can connect directly to leg 30*a* External braces 34*a–d* form triangular support structures with respective legs and table pieces, adding significant support capability near the ends of the table.

V-shaped central truss member 36 is pivotally attached under center region 26. When table 20 is collapsed, truss member 36 folds against table piece 24. Truss member 36 has a cable attachment point 38 through which all end-to-end cable segments pass. Running the cables through central attachment point 38 provides the important benefit of supporting the center region of the table while also creating unhindered space under the sides of the table for a massage practitioner to operate without interference from cables, trusses or other structures.

Figure 2:
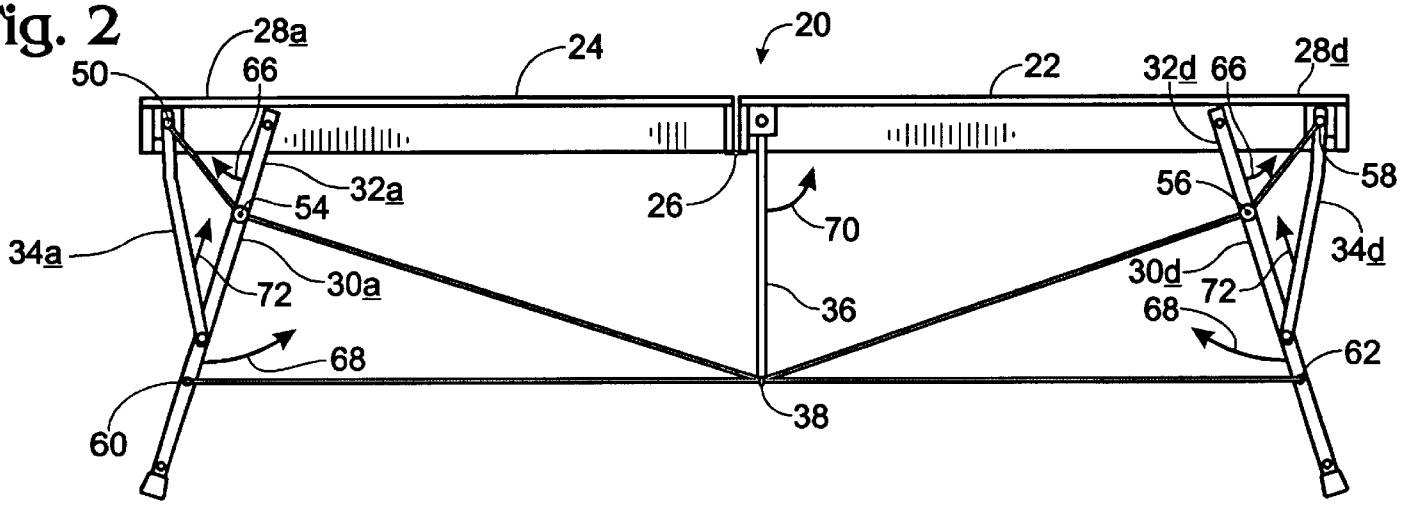
FIG. 2 is a side view of the table shown in FIG. 1.

A side of table 20 is shown in FIG. 2. Opposing comer regions 28*a* and 28*d* are visible. The table in FIG. 2 is shown in its "set up" or upright position. Each of legs 30*a* and 30d is "over-center" or "hyper-rotated," meaning that the leg forms an acute angle with the closest table end. The over-center orientation of leg 30*a* creates a rotational moment that is counteracted by cabling tensions and external brace 34*a*. As shown in FIG. 2, a cable network runs in tension between various points along the rigid structures underneath the table. A first cable connects points 50 and 54 under comer region 28*a*. Similarly, a cable connects points 56 and 58 under comer region 28*d*. A third cable connects point 54, to point 38, to point 56. A fourth cable connects point 60, to point 38, to point 62. In a preferred embodiment truss member 36 extends further toward the ground beneath the level of points 60 and 62, so that the fourth cable urges truss member 36 upward. Alternatively, a third cable may connect point 54, to point 38, to point 62; in which case, the fourth cable connects point 60, to point 38, to point 56. It is important to note that cable attachment points 54 and 56 coincide with the respective pivot points between links and legs.

Each of links 32*a*, 32*d* and truss 36 is substantially perpendicular to a tangent of the cable it is connected to. Thus, each of links 32*a* and 32*d* function to some extent like truss members in response to cable tension, similar to truss member 36.

FIG. 2 also contains arrows that demonstrate how the table folds up. When the table is collapsed, links 32*a* and 32*d* fold in the direction of arrows 66. Legs 30*a* and 30*d* fold in the direction of arrows 68. Truss member 36 folds in the direction of arrow 70. When table 20 is collapsed, external braces 34*a* and 34d fold in the direction of arrows 72.

The table design shown in FIGS. 1 and 2 sets up automatically when the table halves are opened. When the table is collapsed, some manual manipulation is required to initiate folding of the legs and links, after which it collapses substantially automatically.

Figure 3:
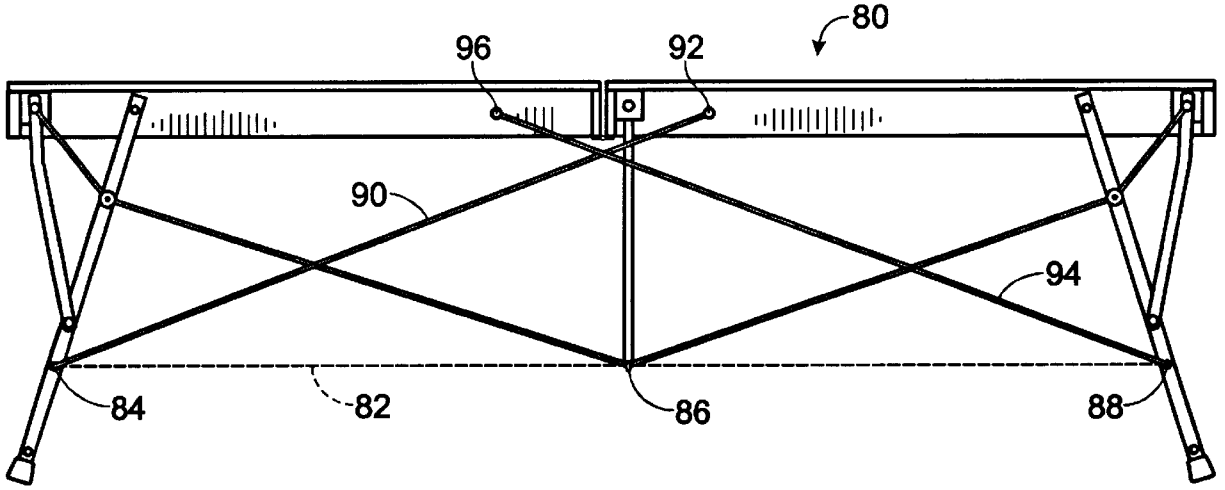
FIGS. 3–5 are side views of alternative collapsible table embodiments.

An alternative embodiment of the table shown in FIGS. 1 and 2, is shown in FIG. 3. Table 80 is the same as table 20 except instead of running cable 82 (dashed lines) from point 84, to point 86, to point 88; cable 90 runs from point 84 to point 92, and cable 94 runs from point 88 to point 96.

Figure 4:
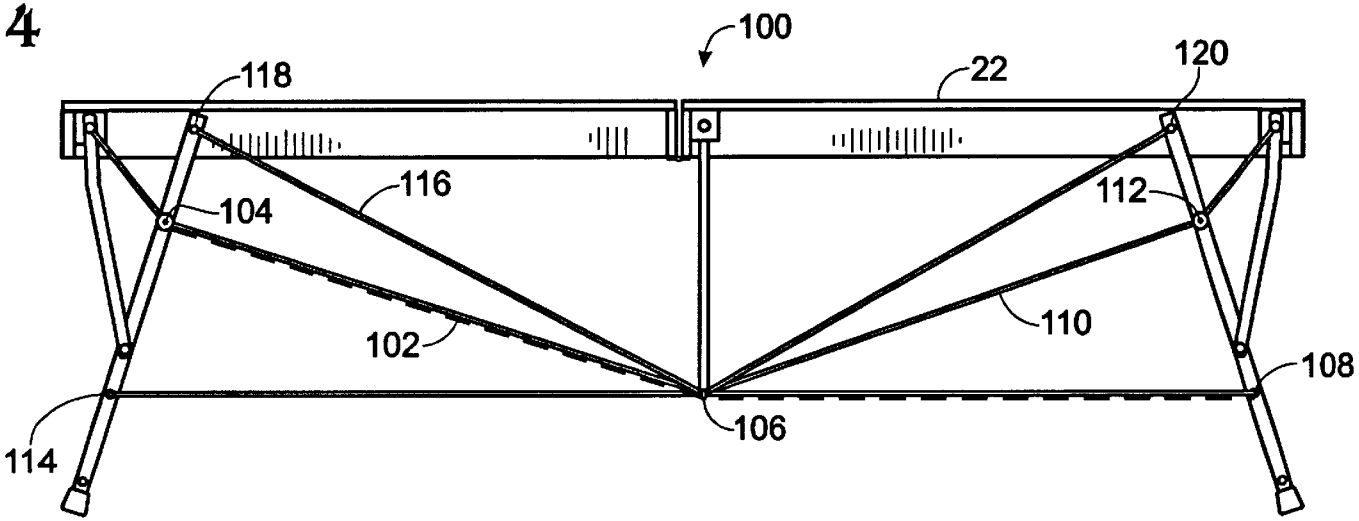

Another cable configuration is shown in FIG. 4. Table 100 utilizes substantially the same hardware as table 20 in FIGS. 1 and 2, however, it employs an additional cable. A first cable 102 connects point 104, to point 106, to point 108. A second cable 110 connect point 112, to point 106, to point 114. A third cable 116 connects point 118, to point 106, to point 120.

Figure 5:
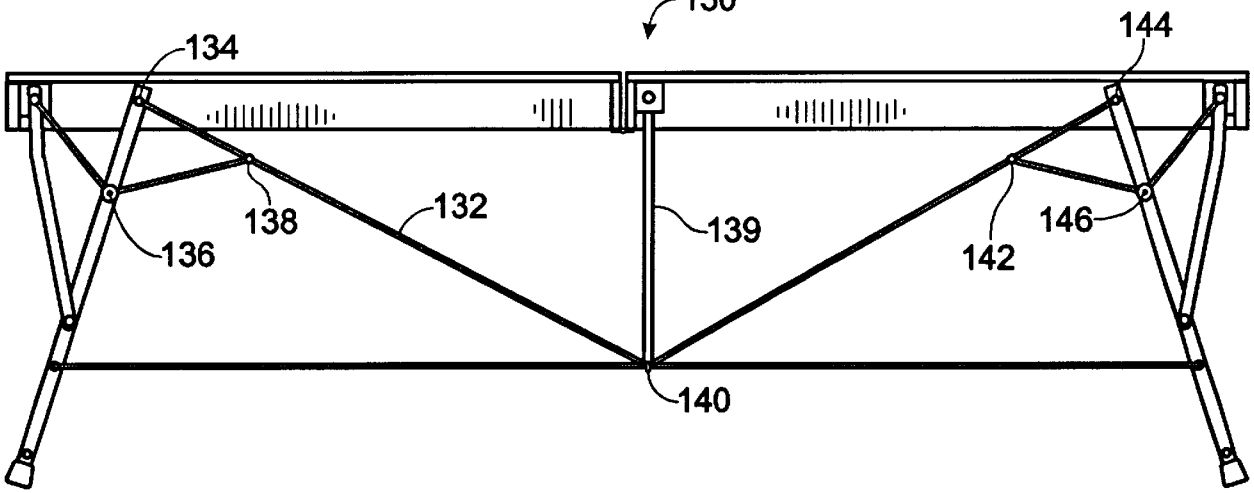

Another cable configuration is shown in FIG. 5. Table 130 utilizes a split cable configuration in which cable 132 runs from points 134 and 136 to point 138 where they are joined, then to point 140 on truss 139, to point 142 where it splits again, and then to points 144 and 146.

Figure 6A:
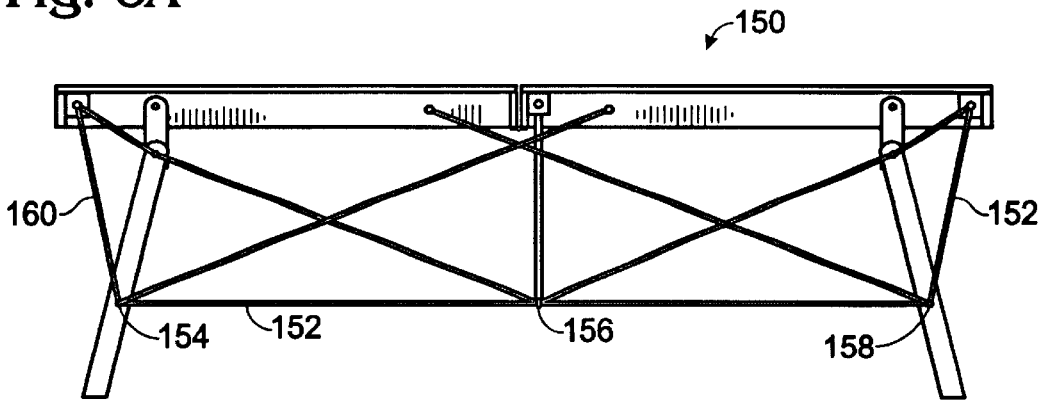
FIG. 6A is a side view of another collapsible table.
Figure 6B:
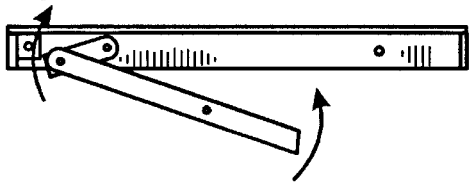
FIG. 6B is a partial side view of a partially folded portion of the table shown in FIG. 6A.

FIG. 6A shows an alternative table design which is substantially the same as table 80 shown in FIG. 3, except for two differences. First, table 150 uses an additional cable 152 running from point 154, to point 156, to point 158. Second, instead of external rigid braces, cables 160 and 162 connect legs to their respective table ends. FIG. 6B shows a partial view of leg and link members partially collapsed.

Figure 7A:
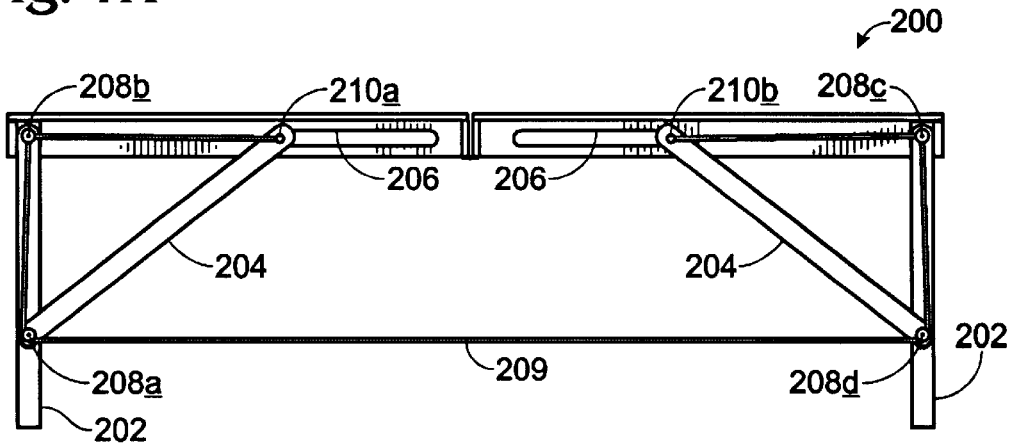
FIGS. 7A–H are side views of other collapsible table designs employing right angle leg configurations.

FIGS. 7A–H illustrate improvements relating to tables that employ legs that are perpendicular to the table top when the table is set up. Table 200 in FIG. 7A is shown from the side. Table 200 has legs 202 supported by diagonal braces 204. Upper ends of braces 204 are moveable in respective slots 206. Pulleys are located at points 208*a* –*d*. Cable 209 runs from point 210*a* around the pulley at point 208*b*, around the pulley at point 2081 around the pulley at point 208*d*, around the pulley at point 208*c*, and then is attached to point 210*b*. When the table is set up, cable 209 pulls the upper ends of diagonal braces 204 toward the outermost ends of respective slots 206.

Figure 7B:
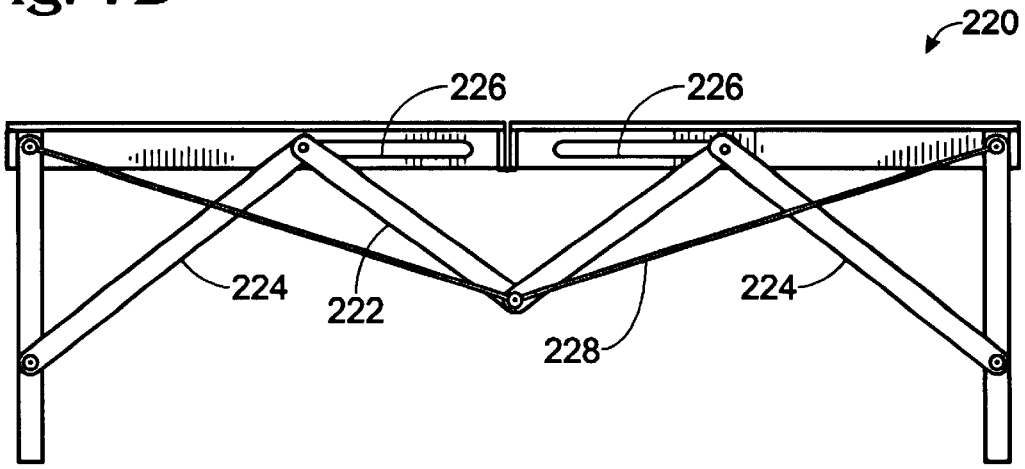

Table 220 in FIG. 7B is similar to table 200 in FIG. 7A, except that a V-shaped truss structure 222 is pivotally attached to the upper ends of diagonal braces 224. Truss structure 222 pushes the upper ends of braces 224 toward the outermost ends of respective slots 226 in response to an upward force generated by tensioned cable 228.

Figure 7C:
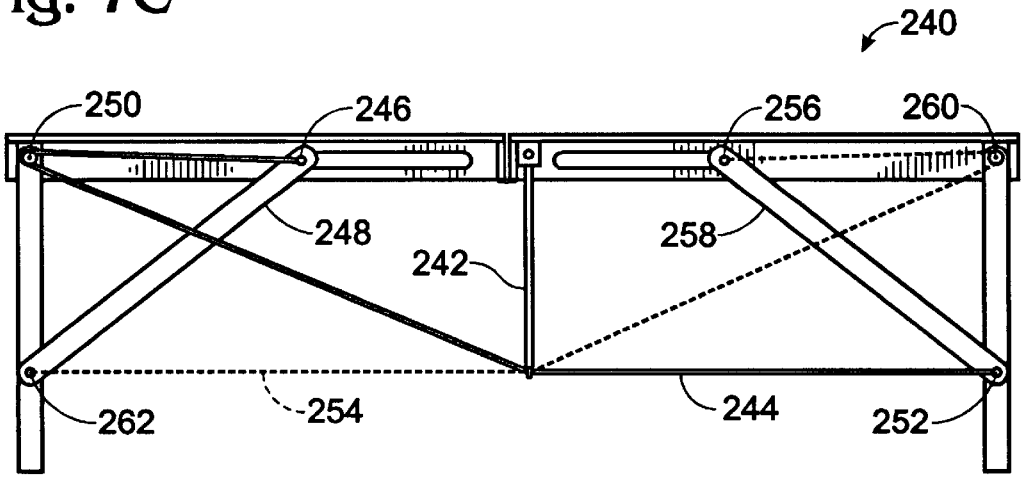

FIG. 7C shows table 240 which is similar to tables previously described, except a different cable arrangement is used to secure the diagonal braces. A single truss member 242 is oriented vertically under the center of the table. A first cable 244 is connected to point 246 at an uppermost end of diagonal brace 248. Cable 244 then passes around a pulley located at point 250. Cable 244 runs from point 250 over a distal tip of truss member 242, to point 252 on the opposing leg. Similarly, cable 254 is attached at point 256 at the upper end of diagonal brace 258. Cable 254 then passes around a pulley located at point 260. Cable 254 runs from point 260 over the distal tip of truss member 242, to point 262.

Figure 7D:
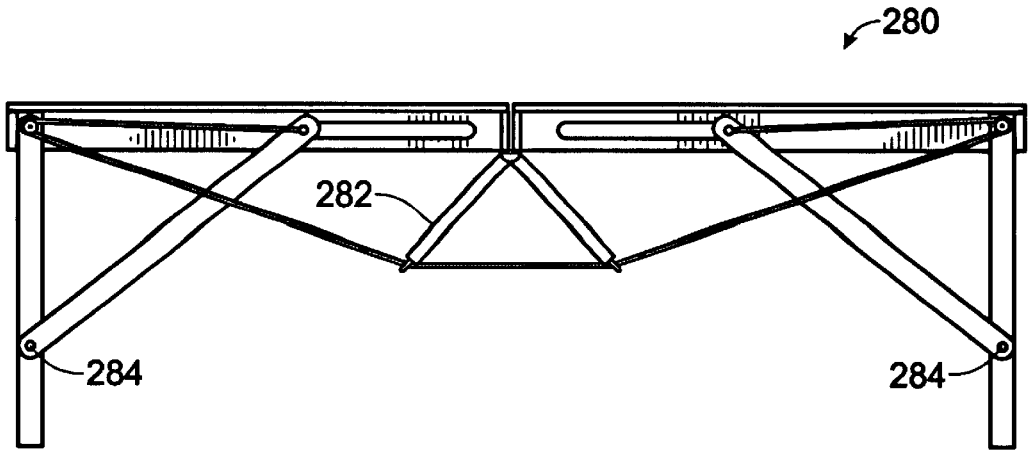
Figure 7E:
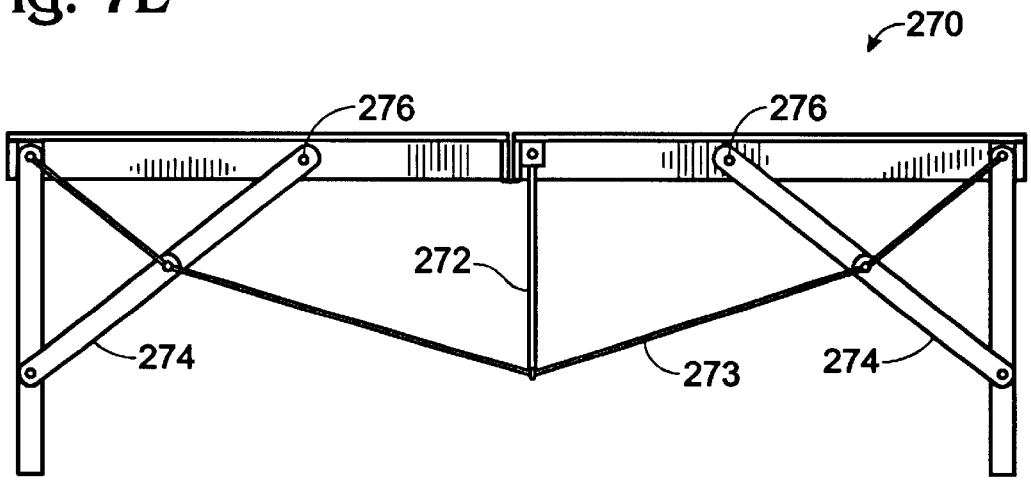

Table 270 in FIG. 7E illustrates an advantage that is made possible by using central truss member 272. Truss member 272 lowers the pulling direction of cable 273 on the joints of diagonal braces 274. This makes it possible to use shorter diagonal braces in comparison to similar tables that do not use a central truss. Thus, the points 276 where diagonal braces 274 are connected to the table top can be moved outward to some extent firm the center of the table.

Table 280 in FIG. 7D is similar to table 240 in FIG. 7C, except an upside down V-shaped truss 282 is used, and there are no cable connections to point 284.

Figure 7F:
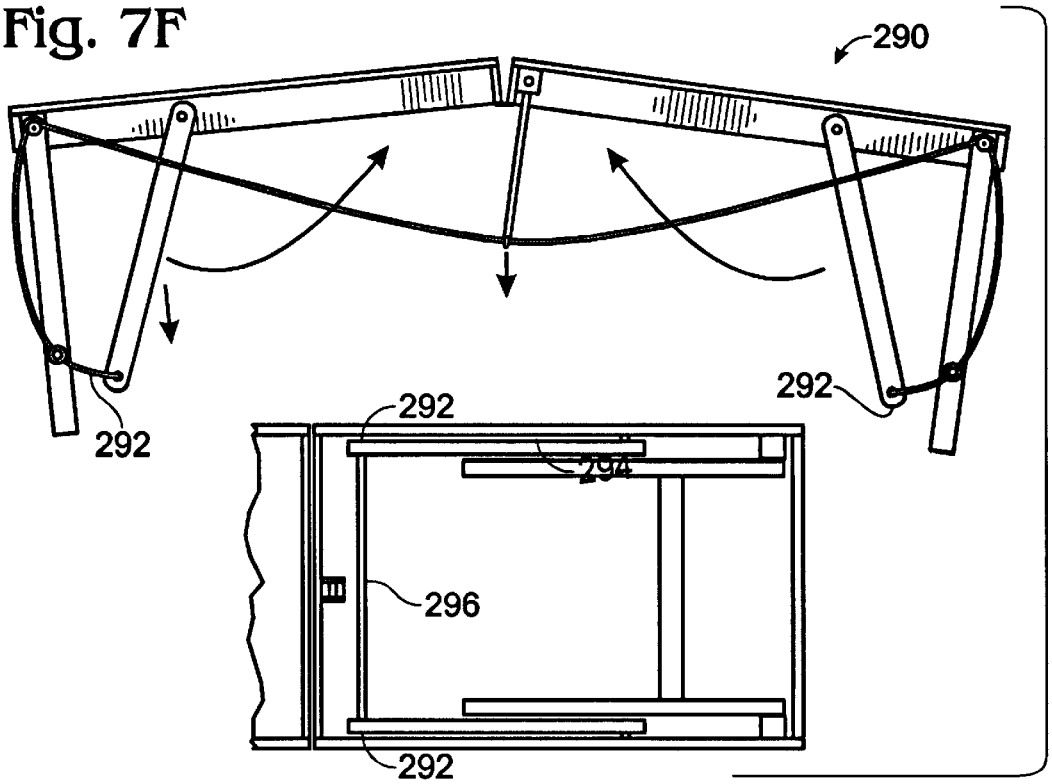

FIG. 7F shows table 290 which differs from previously described tables because the ends 292 of the diagonal braces are free until cable 294 pulls them into contact with their respective legs. An underview of table 290 shows that diagonal braces on opposing sides of the table are connected and stabilized by cross-brace 296.

Figure 7G:
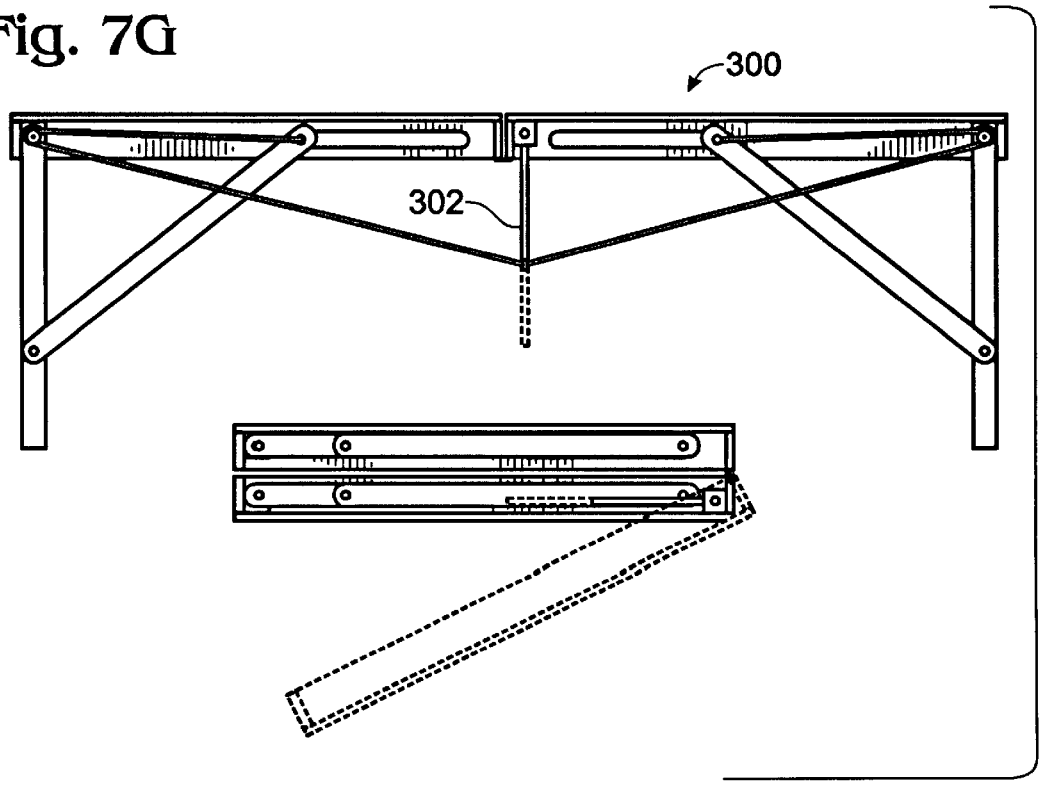

Table 300 in FIG. 7G uses a telescoping central truss member 302. Truss member 302 telescopes when table 300 is collapsed in order to provide slack for the cable, which is necessary for the table to fold up.

Figure 7H:
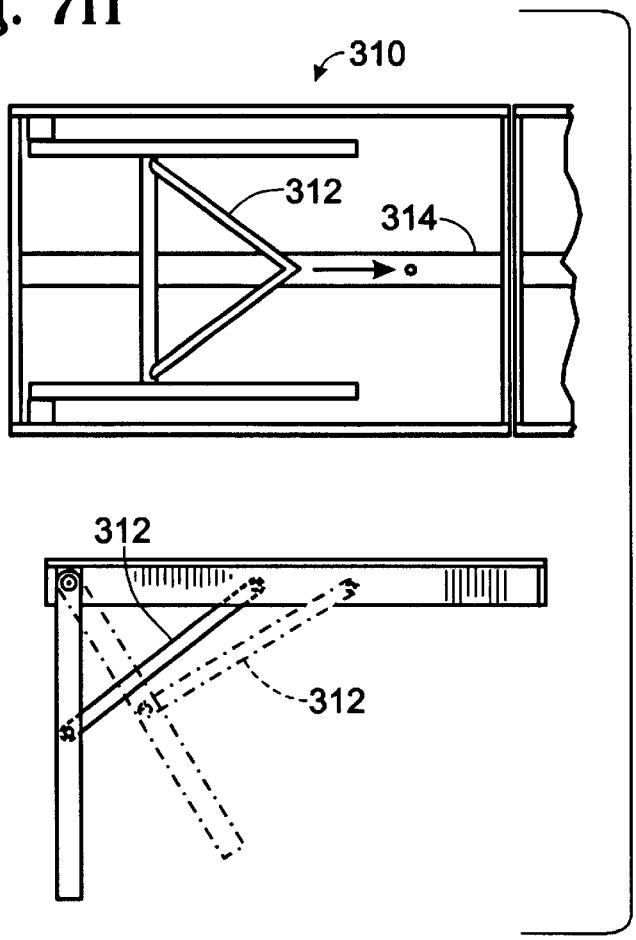

In FIG. 7H, table 310 uses diagonal braces 312 that are capable of sliding on a central track 314 instead of slots such as slots 206 in table 200, as shown in FIG. 7A.

Figure 8:
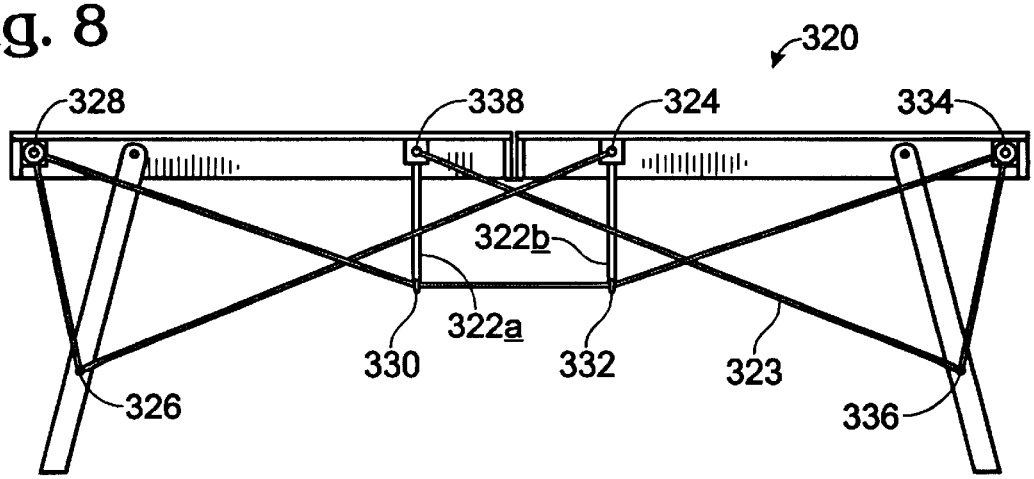
FIG. 8 is a side view of another collapsible table configuration employing over-the-center legs.

FIG. 8 shows another table design that uses over-the-center legs. Table 320 uses two trusses 322*a,b* spaced apart on opposite sides of the center of the table. Cable 323 runs from point 324 at the base of truss 322*b*, to point 326, around a pulley at point 328, to point 330 at the distal tip of truss 322*a*, to point 332 at the distal tip of truss 322*b*, around a pulley at point 334, to point 336, to point 338.

Numerous embodiments of the invention have been described and illustrated in detail. However, many other modifications of the designs are also enabled and covered by the following claims.

I claim:

1. A collapsible table, comprising two folding table pieces hingably connected so that when the table is set up it has four corner regions and a center region, each corner region being supported by a leg and a diagonal support, wherein the diagonal support has a first end portion pivotally connected to the leg and a second end portion that moves in a slot when the table is set up and collapsed, and a cable that stabilizes the diagonal supports when the table is set up.

2. The table of claim 1 further comprising a central truss member connected to the cable network under the center region of the table.

3. The table of claim 2, wherein the central truss member is positioned substantially inward from a side of the table.

4. The table of claim 1 further comprising a V-shaped central truss member having a point that is connected to the cable network.

* * * * *